United States Patent [19]

Leaney et al.

[11] Patent Number: 5,047,635

[45] Date of Patent: Sep. 10, 1991

[54] DOWN-HOLE PROBE ASSEMBLIES

[75] Inventors: Peter A. Leaney, Cheltenham; Keith Lathan, Gloucester, both of United Kingdom

[73] Assignee: Baroid Technology, Inc., Houston, Tex.

[21] Appl. No.: 621,798

[22] Filed: Dec. 4, 1990

[30] Foreign Application Priority Data

Dec. 6, 1989 [GB] United Kingdom ..... 8927619

[51] Int. Cl.[5] ..... G01V 5/04

[52] U.S. Cl. ..... 250/256; 250/254; 250/361 R; 250/483.1; 73/152

[58] Field of Search ..... 250/261, 254, 256, 361 R, 250/483.1; 73/152

[56] References Cited

U.S. PATENT DOCUMENTS

| | | | |
|---|---|---|---|
| 3,258,593 | 6/1966 | Reed et al. | 250/261 |
| 3,265,893 | 8/1966 | Rabson et al. | 250/261 |
| 4,004,151 | 4/1977 | Novak | 250/485 |
| 4,158,773 | 10/1979 | Novak | 250/361 R |
| 4,335,602 | 6/1982 | Walkow | 73/152 |
| 4,383,175 | 7/1983 | Toepke | 250/368 |
| 4,764,677 | 1/1988 | Spurney | 250/361 R |
| 4,994,673 | 2/1991 | Perna et al. | 250/361 R |

*Primary Examiner*—Carolyn E. Fields

*Attorney, Agent, or Firm*—Browning, Bushman, Anderson & Brookhart

[57] ABSTRACT

A downhole probe for use in conditions of high vibration or shock comprises a vibration-sensitive inner unit having a cylindrical outer surface, an outer casing having a cylindrical inner surface within which the inner unit is accommodated, and an intermediate vibration-damping composite sleeve extending between said inner and outer surfaces. The composite sleeve has two coaxial sleeve parts fitting one within the other and consisting of an apertured metal sleeve part and an elastomeric sleeve part having axial ribs which extend through axial slots in the apertured sleeve part. The axial ribs of the elastomeric sleeve part engage the inner surface of the outer casing and inner surfaces of the elastomeric sleeve part engage the outer surface of the inner unit so as to support the inner unit within the outer casing in such a manner as to provide efficient isolation of the inner unit from external vibration and shock.

10 Claims, 2 Drawing Sheets

DOWN-HOLE PROBE ASSEMBLIES

BACKGROUND OF THE INVENTION

This invention relates to down-hole probe assemblies for use in conditions of high vibration or shock, such as are encountered within the bottomhole assembly of a rotating drill string during drilling.

During downhole measurement-while-drilling (MWD) one or more measurement probes are located inside the drill collar portion of the drill string close to the drill bit, and there is a risk that such measurement probes will suffer damage or that the measurements taken will be compromised by the high levels of vibration or shock to which the probes are subjected in use.

One form of probe which is used is the gamma ray detector probe which detects the gamma radiation received from radioactive elements in the formations penetrated by the borehole being drilled, for the purpose of producing a gamma ray log against depth for use in formation analysis. Such gamma ray detector probes generally comprise a scintillation counter having a gamma ray scintillator crystal and a photomultiplier tube joined at an optical interface formed, for example, of silicone grease. The integrity of the optical interface between the crystal and the photomultiplier tube can be affected by vibrations and this can seriously compromise the performance of the scintillation counter.

It is an object of the invention to improve the mounting of a scintillation counter or other vibration-sensitive inner unit of a downhole probe assembly so as to protect the unit against the effects of vibration.

SUMMARY OF THE INVENTION

According to the present invention there is provided a downhole probe assembly for use in conditions of high vibration or shock, comprising a vibration-sensitive inner unit having a cylindrical outer surface, an outer casing having a cylindrical inner surface within which the inner unit is accommodated, and an intermediate vibration-damping composite sleeve extending between said inner and outer surfaces and having two coaxial sleeve parts fitting one within the other and consisting of an apertured sleeve part made of relatively rigid material and a further sleeve part made of relatively resilient material having portions which extend through apertures in the apertured sleeve part, whereby portions of the further sleeve part engage said inner surface and further portions of the further sleeve part engage said outer surface so as to support the inner unit within the outer casing.

Preferably the further sleeve part fits within the apertured sleeve part so that inner portions of the further sleeve part engage the outer surface of the inner unit and outer portions of the further sleeve part extend through apertures in the apertured sleeve part and engage the inner surface of the outer casing.

In a preferred embodiment the apertured sleeve part has a cylindrical wall having a plurality of axial slots therethrough regularly spaced about the circumference of the wall, and the further sleeve part has a generally cylindrical wall having axial ribs which extend through said slots.

In this regard the sleeve will usually be of generally circular cross-section, although sleeves of other cross-sections, such as hexagonal, triangular or square, are also contemplated within the scope of the invention, particularly where the inner and outer cylindrical surfaces of the outer casing and the inner unit have cross-sections which are other than circular.

Furthermore the further sleeve part may have portions of its wall which are bowed in cross-section to form said axial ribs, and may have elongate recesses in portions of its wall intermediate said axial ribs such that the edges of the recesses engage facing wall portions of said apertured sleeve part. Also the further sleeve part may be made of elastomeric material. These features enhance the ability of the further sleeve part to damp external vibrations whilst allowing for thermal expansion of the further sleeve part.

In addition the inner unit may be subjected to axial loading at its ends by end caps at the ends of the sleeve.

Furthermore the sleeve may be resiliently supported within the outer casing by biasing means acting axially between each end of the sleeve and a respective adjacent end wall of the outer casing.

The end caps may be provided with axial extensions which extend into axial bores in the end walls of the outer casing for guiding the ends of the sleeve, and the biasing means may be constituted by compression springs surrounding said axial extensions. At least one of the end caps may also be formed with a bore for electrical leads passing to the inner unit.

In one application the inner unit comprises a cylindrical gamma ray scintillator crystal and a cylindrical photomultiplier tube placed end to end with their adjacent ends separated by an elastomeric optical interface member. The mounting arrangement provides both lateral and axial isolation from external vibration of the inner unit, and particularly of the sensitive optical interface member.

BRIEF DESCRIPTION OF THE DRAWINGS

In order that the invention may be more fully understood, a preferred embodiment of the invention will now be described, by way of example, with reference to the accompanying drawings, in which.

DETAILED DESCRIPTION OF THE DRAWINGS

Figure 1:
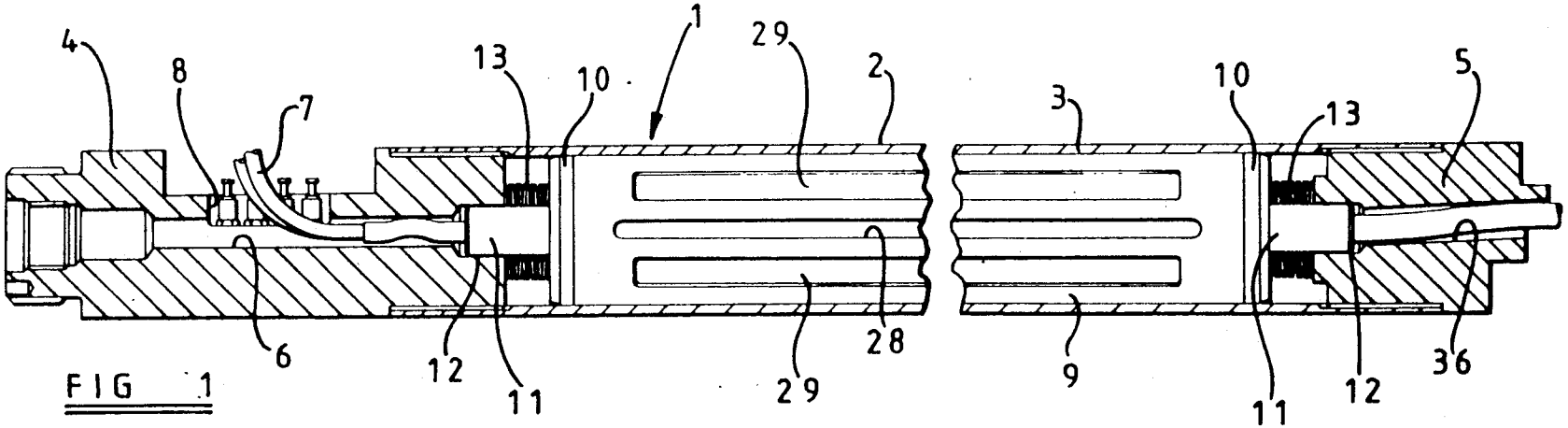
FIG. 1 is a section through two end portions of a downhole probe assembly incorporating a gamma ray detector.

Referring to FIG. 1 the probe 1 has an outer casing 2 having a cylindrical wall 3 extending between an interconnection bulkhead 4 and an electromagnetic shield body 5. The interconnection bulkhead 4 has an axial bore 6 into which electrical leads 7 extend through a side opening 8. The outer casing 2 accommodates a vibration-sensitive inner unit within a vibration-damping composite sleeve 9 having end caps 10 provided with axial extensions 11 which are received within cylindrical recesses 12 respectively in the interconnection bulkhead 4 and the shield body 5. The axial extensions 11 are surrounded by compression springs 13 whose function will be described below.

Figure 2:
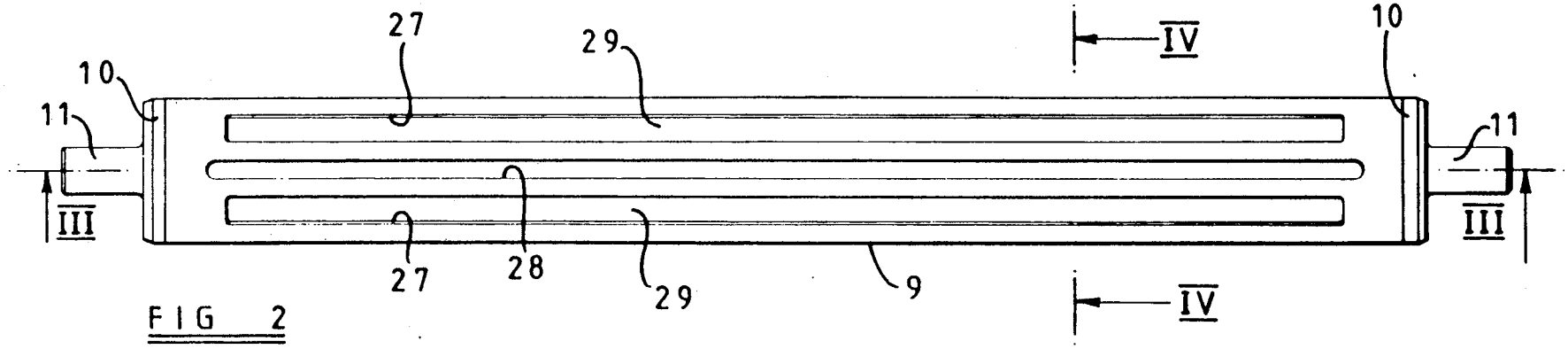
FIG. 2 is a side view of the vibration-damping sleeve of the assembly accommodating the detector.
Figure 3:
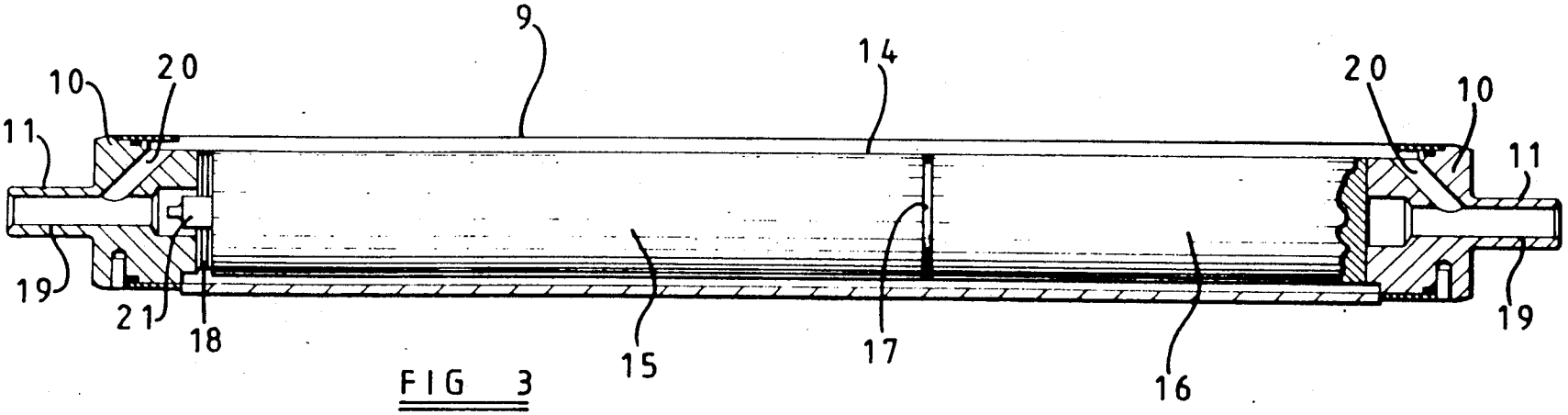
FIG. 3 is an axial section taken along the line III—III in FIG. 2.

FIG. 2 shows the vibration-damping composite sleeve 9, within which the inner unit is accommodated, removed from the outer casing 2. Furthermore FIG. 3, which is a section along the line III—III in FIG. 2, shows the inner unit 14 having a cylindrical outer surface surrounded by the sleeve 9 and consisting of a cylindrical sodium iodide scintillator crystal 15 and a cylindrical photomultiplier tube 16 placed end to end with their adjacent ends separated by an isolating optical interface in the form of a silicone rubber disc 17.

The components 15, 16 and 17 of the inner unit 14 are preloaded axially between the end caps 10 with the interposition of shims 18 of the required thickness, the rubber disc !7 providing some resilience in the mounting of these components. Furthermore the end caps 10 are held fixedly and sealingly on the ends of the sleeve 9 in known manner and are provided with axial bores 19 for the passage of electrical leads. In addition branch bores 20 are provided in the end caps 10 for a purpose which will be apparent from the following description. A solder bucket 21 extends through the shims 18 and is provided for the connection of wiring to the crystal 15.

Figure 4:
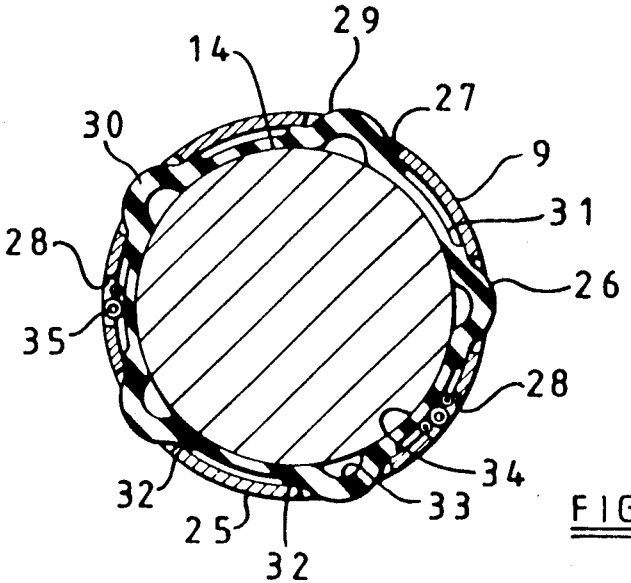
FIG. 4 is a cross-section taken along the line IV—IV in FIG. 2.

Referring to FIG. 4, the vibration-damping composite sleeve 9 shown therein in cross-section comprises an apertured metal sleeve part 25 and an elastomeric sleeve part 26 made, for example, of rubber. The metal sleeve part 25 is formed with five axial slots 27, and also two further axial slots 28 which are provided for the passage of wiring extending between the axial bores 19 of the end caps 10 by way of the branch bores 20.

As may be seen in FIG. 4, the five axial slots 27 are regularly spaced about the circumference of the cylindrical wall of the metal sleeve part 25, and are provided for receiving corresponding axial ribs 29 provided on the generally cylindrical elastomeric sleeve part 26. The axial ribs 29 are formed by outwardly bowed portions 30 of the wall of the elastomeric sleeve part 26 which project through the axial slots 27 so as to engage the inner cylindrical surface of the outer casing wall 3 when the composite sleeve 9 is fitted within the outer casing 2.

Furthermore the elastomeric sleeve part 26 is formed with five elongate recesses 31 in the portions of the sleeve part wall intermediate the axial ribs 29 such that the recesses 31 face the inside wall of the metal sleeve part 25 and such that the edges 32 of the recesses 31 engage the facing wall portions of the metal sleeve part 25. The bowed walled portions 30 of the elastomeric sleeve part 26 also form axial grooves 33 in the inside surface of the sleeve part 26 and define between the grooves 33 axial lands 34 for engaging the outer cylindrical surface of the inner unit 14.

Thus the vibration-damping sleeve 9 provides lateral isolation of the inner unit 14 with respect to external vibration applied to the outer casing 2 by virtue of the fact that the axial lands 34 of the elastomeric sleeve part 26 engage the outer surface of the inner unit 14 and the axial ribs 29 of the sleeve part 26 engage the inner surface of the outer casing 2. The form of the elastomeric sleeve part 26 is such as to enhance the ability of the sleeve 9 to damp external vibrations whilst allowing for thermal expansion of the sleeve part 26 under the effect of the high temperatures encountered down-hole. Furthermore the metal sleeve part 25 serves to maintain the structural form of the elastomeric sleeve part 26 whilst in no way prejudicing the vibration-damping properties of the composite sleeve 9.

Various modifications of the form of the vibration-damping composite sleeve 9 are contemplated within the scope of the invention. For example the number and the axial extent of the axial ribs 29 may be varied. Also the metal sleeve part may be inside the elastomeric sleeve part in which case provision would be made for portions of the elastomeric sleeve part to project inwardly through slots in the metal sleeve part.

As previously mentioned axial slots 28 are provided in the metal sleeve part 25 for the passage of wiring, indicated at 35 in FIG. 4. As may be seen in FIG. 1 an axial bore 36 is provided in the shield body 5 for the passage of such wiring, and wiring from the photomultiplier tube, to associated processing electronic circuitry (not shown).

In addition, axial isolation of the inner unit 14 with respect to vibrations applied to the outer casing 2 is provided by virtue of the fact that the axial extensions 11 of the end caps 10 are a loose fit within the recesses 12, and by virtue of the compression springs 13 acting between the interconnection bulkhead 4 and the end cap 10 at one end of the inner unit 14 and between the shield body 5 and the end cap 10 at the other end of the inner unit 14. The combination of lateral and axial isolation from vibration ensures that the inner unit 14, and the particularly the sensitive optical interface between the crystal 15 and the photomultiplier tube 16, is well protected from the effects of external vibration.

Finally it is envisaged that a similar vibration damping arrangement to that described above may be used to protect other types of inner unit, such as Geiger-Müller counters and other forms of downhole measurement transducer, as well as sensitive electronic circuitry.

We claim:

1. A downhole probe assembly for use in conditions of high vibration or shock, comprising a vibration-sensitive inner unit having a cylindrical outer surface, an outer casing having a cylindrical inner surface within which the inner unit is accommodated, and an intermediate vibration-damping composite sleeve extending between said inner and outer surfaces and having two coaxial sleeve parts fitting one within the other and consisting of an apertured sleeve part made of relatively rigid material and a further sleeve part made of relatively resilient material having portions which extend through apertures in the apertured sleeve part, whereby portions of the further sleeve part engage said inner surface and further portions of the further sleeve part engage said outer surface so as to support the inner unit within the outer casing in such a manner as to isolate the inner unit from substantial external vibration and shock.

2. An assembly according to claim 1, wherein the further sleeve part fits within the apertured sleeve part so that inner portions of the further sleeve part engage the outer surface of the inner unit and outer portions of the further sleeve part extend through apertures in the apertured sleeve part and engage the inner surface of the outer casing.

3. An assembly according to claim wherein the apertured sleeve part has a cylindrical wall having a plurality of axial slots therethrough regularly spaced about the circumference of the wall, and the further sleeve part has a generally cylindrical wall having axial ribs which extend through said slots.

4. An assembly according to claim 3, wherein the further sleeve part has portions of its wall which are bowed in cross-section to form said axial ribs.

5. An assembly according to claim 3, wherein the further sleeve part has elongate recesses in portions of its wall intermediate said axial ribs such that the edges of the recesses engage facing wall portions of said apertured sleeve part.

6. An assembly according to claim wherein the further sleeve part is made of elastomeric material.

7. An assembly according to claim 1, wherein the inner unit is subjected to axial loading at its ends by end caps at the ends of the sleeve.

8. An assembly according to claim 7, wherein the sleeve is resiliently supported within the outer casing by biasing means acting axially between each end of the sleeve and a respective adjacent end wall of the outer casing.

9. An assembly according to claim 8, wherein the end caps are provided with axial extensions which extend into axial bores in the end walls of the outer casing for guiding the ends of the sleeve, and the biasing means are constituted by compression springs surrounding said axial extensions.

10. An assembly according to claim 1, wherein the inner unit comprises a cylindrical gamma ray scintillator crystal and a cylindrical photomultiplier tube placed end to end with their adjacent ends separated by an elastomeric optical interface member.

* * * * *

UNITED STATES PATENT AND TRADEMARK OFFICE

CERTIFICATE OF CORRECTION

PATENT NO. : 5,047,635

DATED : September 10, 1991

INVENTOR(S) : Peter A. Leaney et al

It is certified that error appears in the above-identified patent and that said Letters Patent is hereby corrected as shown below:

Col. 4, Claim 3, line 55, after "claim", insert --1,--.

Col. 5, Claim 6, line 2, after "claim", insert --1,--.

Signed and Sealed this

Second Day of March, 1993

*Attest:*

STEPHEN G. KUNIN

*Attesting Officer*

*Acting Commissioner of Patents and Trademarks*